US006888945B2

(12) United States Patent
Horrall

(10) Patent No.: US 6,888,945 B2
(45) **Date of Patent: *May 3, 2005**

(54) PERSONAL SOUND MASKING SYSTEM

(75) Inventor: Thomas R. Horrall, Harvard, MA (US)

(73) Assignee: Acentech, Inc., Cambridge, MA (US)

( * ) Notice: Subject to any disclaimer, the term of this patent is extended or adjusted under 35 U.S.C. 154(b) by 583 days.

This patent is subject to a terminal disclaimer.

(21) Appl. No.: 09/780,978

(22) Filed: Feb. 9, 2001

(65) Prior Publication Data

US 2001/0021259 A1 Sep. 13, 2001

Related U.S. Application Data

(63) Continuation-in-part of application No. 09/266,186, filed on Mar. 10, 1999, now Pat. No. 6,188,771.
(60) Provisional application No. 60/077,535, filed on Mar. 11, 1998.

(51) Int. Cl.[7] ..... H04R 3/02
(52) U.S. Cl. ..... 381/73.1; 381/94.3
(58) Field of Search ..... 381/73.1, 71.1, 381/71.2, 71.4, 71.6, 71.13, 71.14, 94.1, 94.2, 94.3, 94.7

(56) References Cited

U.S. PATENT DOCUMENTS

| | | | | |
|---|---|---|---|---|
| 3,298,455 A | | 1/1967 | Kodaras et al. | 181/0.5 |
| 3,497,623 A | | 2/1970 | Todd | 179/1.5 |
| 3,567,863 A | | 3/1971 | Morrissey | 179/1 |
| 3,879,578 A | | 4/1975 | Wildi | 179/1.5 M |
| 3,980,827 A | | 9/1976 | Sepmeyer et al. | 179/1 P |
| 3,985,200 A | | 10/1976 | Sepmeyer | 181/150 |
| 3,985,957 A | | 10/1976 | Torn | 179/1.5 M |
| 4,010,324 A | | 3/1977 | Jarvis et al. | 179/1 P |
| 4,052,564 A | | 10/1977 | Propst et al. | 179/1.5 M |
| 4,052,720 A | * | 10/1977 | McGregor et al. | 340/522 |
| 4,054,751 A | | 10/1977 | Calder et al. | 179/1.5 M |
| 4,059,726 A | | 11/1977 | Watters et al. | 179/1.5 M |
| 4,280,019 A | | 7/1981 | Propst et al. | 179/1.5 M |
| 4,319,088 A | | 3/1982 | Orfield | 179/1.5 M |
| 4,390,748 A | | 6/1983 | Zwicker | 179/1 N |
| 4,438,526 A | | 3/1984 | Thomalla | 381/73 |
| 4,450,321 A | | 5/1984 | Quigley et al. | 179/1.5 |
| 4,476,572 A | | 10/1984 | Horrall et al. | 381/73 |
| 4,622,691 A | | 11/1986 | Tokumo et al. | 381/86 |
| 4,654,871 A | | 3/1987 | Chaplin et al. | 381/72 |
| 4,674,124 A | | 6/1987 | Horrall et al. | 381/73.1 |
| 4,686,693 A | | 8/1987 | Ritter | 381/73.1 |
| 4,736,431 A | | 4/1988 | Allie et al. | 381/71.8 |
| 4,914,706 A | | 4/1990 | Krause | 381/73.1 |

(Continued)

FOREIGN PATENT DOCUMENTS

| | | | |
|---|---|---|---|
| JP | 5-108083 | 4/1993 | 381/73.1 |
| JP | 6-175666 | 6/1994 | 381/73.1 |

*Primary Examiner*—Melur Ramakrishnaiah
(74) *Attorney, Agent, or Firm*—Weingarten, Schurgin, Gagnebin & Lebovici LLP

(57) ABSTRACT

A sound masking system for a multi-occupant work area includes a masking signal generator generating incoherent masking sound signals loudspeaker modules interconnected in a daisy-chain fashion, with each loudspeaker module receiving the masking sound signals on input connections and transmitting them to a successive loudspeaker module on output connections. The connections on which the masking sound signals appear in each loudspeaker are shifted by the inter-loudspeaker connections, such that successive loudspeakers automatically emit different masking sound signals for improved diffuseness in the overall masking sound in the work area. Each loudspeaker module has one jack having the input connections and another jack having the output connections, and each jack receives a detachable cable such as telephone cable to connect adjacent loudspeaker modules. The masking sound signals are shifted by a cross connection network between the two jacks in each loudspeaker module.

19 Claims, 7 Drawing Sheets

U.S. PATENT DOCUMENTS 4,185,167 A 6/1990 Cunningham et al. ..... 381/73.1
D311,065 S 10/1990 Theisen et al. ..... D24/99
4,024,535 A 10/1990 Goldstein ..... 381/73.1
5,167,236 A 12/1992 Junker ..... 128/746
5,192,342 A 3/1993 Baron et al. ..... 55/97
5,360,469 A 11/1994 Baron et al. ..... 95/273
5,590,206 A 12/1996 An et al. ..... 381/71.13
5,805,714 A 9/1998 Kasama et al. ..... 381/71.8
5,812,682 A 9/1998 Ross et al. ..... 381/71.12

* cited by examiner

PERSONAL SOUND MASKING SYSTEM

CROSS REFERENCE TO RELATED APPLICATIONS

This application is a continuation in part of U.S. application Ser. No. 09/266,186, filed Mar. 10, 1999 and issued on Feb. 13, 2001 as U.S. Pat. No. 6,188,771, which claims priority under 35 U.S.C. §119 (e) of U.S. Provisional Application No. 60/077,535, Filed Mar. 11, 1998, entitled "Personal Sound Masking System", the disclosures of both of these applications being hereby incorporated by reference herein.

STATEMENT REGARDING FEDERALLY SPONSORED RESEARCH OR DEVELOPMENT

Not Applicable

BACKGROUND OF THE INVENTION

It is well known that freedom from distraction is an important consideration for workers' satisfaction with their office environment. In a conventional enclosed office with full height partitions and doors, any speech sound intruding from outside the office is attenuated or inhibited by the noise reduction (NR) qualities of the wall and ceiling construction. Residual speech sound actually entering the office is normally masked or covered up by even very low levels of background noise, such as from the building heating or ventilating system. Under normal circumstances, the resulting speech audibility is sufficiently low that the office worker is unable to understand more than an occasional word or sentence from outside, and is therefore not distracted by the presence of colleagues' speech. In fact, it was shown more than 35 years ago that a standardized objective measure of speech intelligibility called the articulation index, or AI, could be used to reliably predict most people's satisfaction with their freedom from distraction in the office. "Perfect" intelligibility corresponds to an AI of 1.0, while "perfect" privacy corresponds to an AI of 0.0. Generally, office workers are satisfied with their privacy conditions if the AI of intruding speech is 0.20 or less, a range referred to as "normal privacy".

In recent years, the open plan type of office design has become increasingly popular due to its obvious flexibility and communication advantages. In contrast to conventional closed offices, the open plan design has workspaces with either no separating partitions or only partial height partitions and open doorways, and unwanted speech readily transmits from a talker to unintended listeners in adjacent workspaces. Limited acoustical measures can be employed to reduce the level of the resulting speech that is transmitted. Highly sound absorptive ceilings reflect less speech, and higher partitions diffract less sound energy over their tops. Additionally, doorways may be placed so that no direct line of sight or sound transmission exists from office to office, and the interiors of offices are treated with sound absorptive panels. Nevertheless, even in an acoustically well designed open office, the sound level of intruding speech is substantially greater than in most enclosed offices. In order to obtain the normal privacy goal of 0.20 AI, acousticians know that the level of background sound in the open office must be raised, usually by electronic sound masking systems. Indeed, a considerable proportion of larger contemporary open offices use electronic sound masking systems, sometimes called "white sound" systems. However, few smaller offices use such systems due to prohibitive costs.

Conventional sound masking systems typically comprise four main components; an electronic random noise generator, an equalizer or spectrum shaper, a power amplifier, and a network of loudspeakers distributed throughout the office. The equalizer adjusts the spectrum to compensate for the frequency dependent acoustical filtering characteristics of the ceiling and plenum or air space above and to obtain the spectrum shape desired by the designer. The power amplifier raises the signal voltage to permit distribution to the loudspeakers without unacceptable loss in the network lines. The generator, equalizer, and power amplifier are typically located at a central location connected to the loudspeaker distribution network. A typical system uses loudspeakers serving about 100–200 square feet each (i.e. placed on 10' to 14' centers); the loudspeakers are usually concealed above an acoustical tile ceiling in the plenum space. In most cases, the plenum above the ceiling is an air-return plenum so that the loudspeaker network cable must be enclosed in metal conduit or use special plenum-rated cable in order to meet fire code requirements.

The goal of any sound masking system is to mask the intruding speech with a bland, characterless but continuous type of sound that does not call attention to itself. The ideal masking sound fades into the background, transmitting no obvious information. The quality of the masking sound is subjectively similar to the natural random air turbulence noise generated by air movement in a well-designed heating and ventilating system. The overall shape of the masking spectrum is of paramount importance if the goal of unobtrusiveness is to be met. If it has any readily identifiable or unnatural characteristics such as "rumble," "hiss," or tones, or if it exhibits obvious temporal variations of any type, it readily becomes a source of annoyance itself. However, if the sound has a sufficiently neutral, unobtrusive spectrum of the right shape, it can be raised, without becoming objectionable, to a sound level or volume nearly equal to that of the intruding speech itself, effectively masking it.

Although a distributed, ceiling mounted sound masking system has numerous advantages, such a system has significant disadvantages that interfere with the effectiveness of the system at the level of the individual office worker. For example, mechanical system ducts and other physical obstructions, as well as acoustical variations in the above-ceiling plenum and ceiling components such as vented light fixtures and air return grilles, pose significant challenges to the designer in achieving adequately uniform spectral quality. In many installations, cavity resonances in the plenum occur and cannot be completely ameliorated by equalization or other techniques. As a consequence, the acoustical spectrum obtainable at any one office worker location may be substantially compromised compared to the ideal spectrum desirable at his or her particular location. This non-ideal spectrum and spatial variation throughout the office places an effective upper limit on the effectiveness of the masking system.

Obtaining the correct level or volume of the masking sound also is critical. The volume of sound needed may be relatively low if the intervening office construction, such as airtight full height walls, provides high NR, but it must be relatively high in level if the construction NR is compromised by partial-height intervening partitions or acoustically poor design or materials. Even in an acoustically reasonably well designed open office, the level of masking noise necessary to meet privacy goals may be judged uncomfortable by some individuals, especially those with certain hearing impairments. Some systems use volume controls on each masking loudspeaker to permit their adjustment for good spatial uniformity. Even with this costly measure, variations in level of 3–6 dB throughout an office are typical. This amount of variation typically corresponds to differences in AI of 0.1 to 0.2 and sentence intelligibility differences of more than 80% at different locations throughout the office. Such variations are clearly undesirable. Additionally, masking noise may not be desired in larger conference rooms or other communication spaces sharing ceiling plenums with masked areas, and it is impossible for the designer to fully satisfy both requirements.

Subjective spatial quality is a third important attribute of sound masking systems. The masking sound, like most other natural sources of random noise, must be subjectively diffuse in quality in order to be judged unobtrusive. Naturally generated air noise from an HVAC system typically is radiated by many spatially separated turbulent eddies generated at the system terminal devices or diffusers. This spatial distribution imparts a desirable diffuse and natural quality to the sound. In contrast, even if a masking system provides an ideal spectrum shape and sound level, its quality will be unpleasantly "canned" or colored subjectively if it is radiated from a single loudspeaker or location. A multiplicity of spatially separated loudspeakers radiating the sound in a reverberant (sound reflective) plenum normally is essential in order to provide this diffuse quality of sound. With some non-reflective ceiling materials and fireproofing materials used in plenums, it is necessary to resort to two or more channels radiating different (incoherent) sound from adjacent loudspeakers in order to obtain a limited degree of diffuseness. Some contemporary masking systems use such techniques, adding significantly to their installation complexity and cost. Despite careful consideration and design, the degree of diffuseness typically obtained is further limited by the economically dictated need to place many of the ceiling loudspeakers on the same signal distribution channel.

Finally, intentional lack of any user accessible controls is a requirement of conventional masking system design. Because the background sound affects the privacy of all occupants in the office, it is not appropriate to permit individual users to control the characteristics of the masking sound, which are relatively critical. Any temporal changes in the masking level throughout the office are seriously objectionable. Controls are typically locked by various security devices, including physical cabinet locks and electronic password controls to generators and other centrally located electronic components.

In addition to the conventional sound masking systems described above, several self-contained general-purpose devices have been used to provide masking sound in offices. These include mechanical devices using fans and various types of electronic sleep aids and "ambient nature environment" units. Although some of these devices have incorporated "white noise" generators, no one system is able to provide the three essential characteristics, for sound masking application, of tailored spectral shaping, adjustable level, and diffuse spatial quality.

BRIEF SUMMARY OF THE INVENTION

In accordance with the present invention, a sound masking system is disclosed that provides sound masking over an multi-occupant area such as an open office workspace using a loudspeaker interconnection scheme that simplifies installation and provides for relatively easy modification.

The system includes at least one masking signal generator that generates multiple incoherent masking sound signals having spectra tailored to achieve a desired masking sound spectrum in the multi-occupant workspace. Each masking signal generator is connected to a number of loudspeaker modules in a daisy-chain fashion, with each loudspeaker module receiving all the masking sound signals on input connections and transmitting them to the next successive loudspeaker on output connections. The loudspeaker in each module is connected to a predetermined input connection. The interconnection between each pair of adjacent loudspeaker modules shifts the input connections on which the masking sound signals appear, such that successive loudspeakers automatically emit different masking sound signals. This feature contributes to desired diffuseness in the masking sound in the workspace.

In one embodiment, each loudspeaker module includes two jacks, one jack including the input connections and the other jack including the output connections. Each jack receives a respective detachable cable connecting the loudspeaker module to an adjacent loudspeaker module in the daisy chain. The detachable cable can be a standard multipair cable such as modular telephone cable, which transfers the masking sound signals between successive loudspeaker modules without changing the connections on which the respective masking sound signals appear. The shifting of the masking sound signals is accomplished by a connection network disposed between the two jacks in each loudspeaker module. For example, when two masking signals are propagating along the daisy chain, the interconnection network of each loudspeaker module simply reverses the connections for the two signals so that the loudspeakers in adjacent loudspeaker modules are automatically connected to different masking sound signals. Only one type of loudspeaker module and one type of cable are needed, so that confusion or mistake during installation are eliminated. The alternating of the masking signals emitted by successive loudspeaker modules is achieved automatically by simply connecting the modules together.

Other aspects, features, and advantages of the present invention are disclosed in the detailed description that follows.

DETAILED DESCRIPTION OF THE INVENTION

Figure 1:
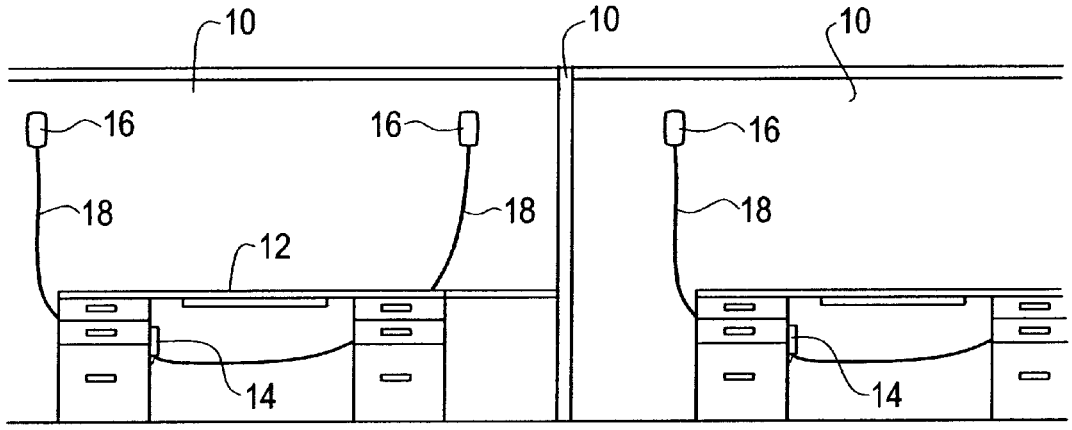
FIG. 1 is an elevation view of a personal sound masking system installed in an open plan office in accordance with the present invention.
Figure 2:
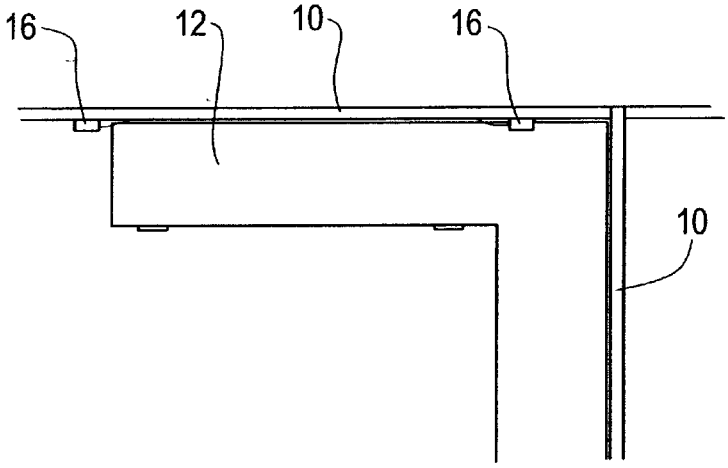
FIG. 2 is a plan view of the installation of FIG. 1.

FIGS. 1 and 2 show a typical open-plan office, often referred to as a "cubicle." The offices are separated by partitions 10 whose height is typically in the range of 4.5 to 7 feet, but may be so low or so acoustically transparent that no acoustical blocking is achieved. The office occupant may sit at a desk 12 or other station. A sound masking system includes a control module 14 mounted on an inside inner panel of the desk 12, using for example mating hook-and-pile tabs secured to the desk 12 and control module 14 respectively. The control module 14 is connected to A and B channel loudspeakers 16 via telephone-type multi-conductor cables 18. The loudspeakers 16 are secured to a partition 10 using suitable means, examples of which are described below.

Figure 3:
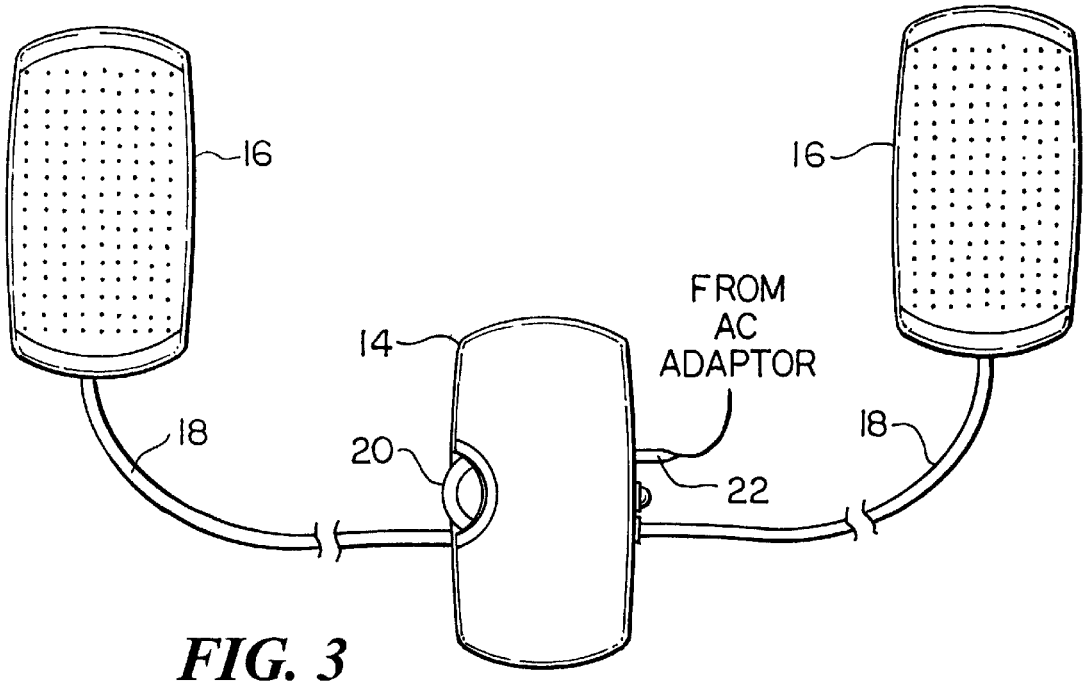
FIG. 3 is a system level assembly diagram of a personal sound masking system in accordance with the present invention.

FIG. 3 shows the elements of the personal sound masking system. The control module 14 has a user-accessible volume control 20. The loudspeaker cables 18 connect to the control module 14 using telephone-type modular plugs and jacks. The control module 14 also contains a jack for receiving a mating plug 22 of an external AC adapter that provides DC power at approximately 7 volts. It will be appreciated that in alternative embodiments DC power may be supplied at other convenient voltages.

Figure 4:
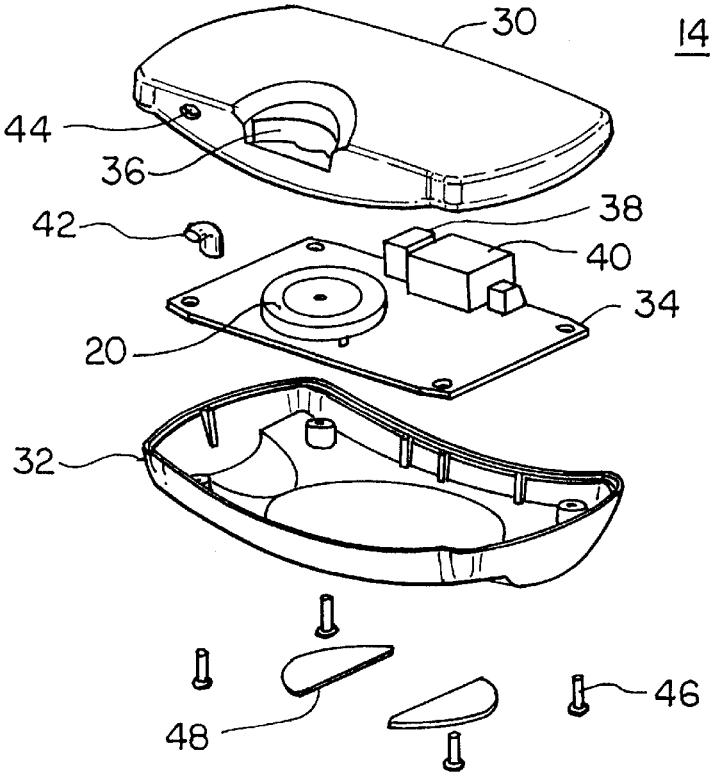
FIG. 4 is an exploded assembly diagram of a control module in the personal sound masking system of FIG. 3.

FIG. 4 shows the elements of the control module 14. The control module 14 includes a top 30, base 32, and a printed 30 circuit board (PCB) assembly 34 containing electronic circuitry that generates sound masking signals that are provided to the loudspeakers 16. The PCB assembly 34 includes the volume control 20, which extends through an opening 36 in the top 30 when the control module 14 is fully assembled. The PCB assembly 34 also includes a DC power jack 38 and a dual modular jack housing 40 for connection to the loudspeakers 16. A light pipe 42 is used to transmit an indication of the presence of DC power from the PCB assembly 34 to an external user via an opening 44 in the top 30. The top 30, base 32, and PCB assembly 34 are secured together using machine screws 46. Adhesive-backed hook-and-pile tab pairs 48 are secured to the outside of the base 32 for securing the control module 14 to a hard external surface.

Figure 5:
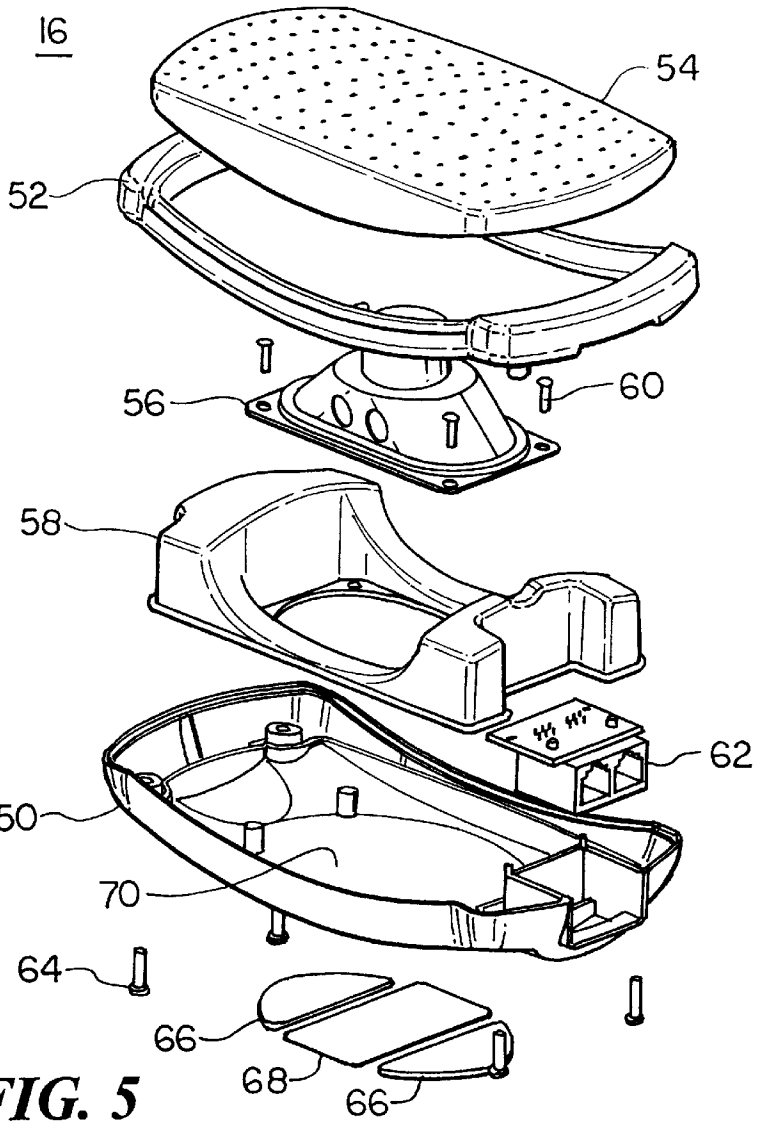
FIG. 5 is an exploded assembly diagram of a loudspeaker module in the personal sound masking system of FIG. 3.

FIG. 5 shows the elements of a loudspeaker module 16. The outer components include a base 50, a top 52, and a grill 54. A loudspeaker 56 is secured to an insert 58 using machine screws 60. The loudspeaker module 16 includes a dual modular jack component 62 connected to the loudspeaker 56 by wires (not shown). The various components of the loudspeaker module 16 are secured together using machine screws 64. Adhesive-backed hook-and-pile tab pairs 66 are secured to the outside of the base 50 for securing the loudspeaker module 16 to an external hard surface. An identifying label 68 is also secured to the outside of the base 50.

Notably, the loudspeaker 56 in the loudspeaker module 16 of FIG. 5 faces toward the base 50 rather than toward the grill 54. This arrangement is preferred in order to reduce an undesirable acoustical interference effect caused by loudspeaker placement relative to reflective surfaces. Sound radiated directly to a listener from a loudspeaker travels a shorter distance than is sound reflected from nearby surfaces. If the reflected sound path at a given frequency is ½ wavelength longer that the direct sound path, the reflected sound suffers a 180 degree relative phase shift and cancels the direct sound. Similarly if the reflected sound travels a full wavelength further than the direct sound, the reflected sound reinforces the direct sound, causing a peak in the response. Similar effects obtain at other even and odd multiples of ½ wavelength. These alternating dips and peaks, or comb filtering action, severely compromise the frequency response and cannot be effectively corrected by frequency equalization.

However, if the radiating surface of the loudspeaker is close to the reflecting surface, this effect occurs at only short wavelengths or higher frequencies. Inverting the loudspeaker so that the distance from the loudspeaker cone to the reflecting surface is minimized moves the effect above the frequency range of interest.

Figure 6:
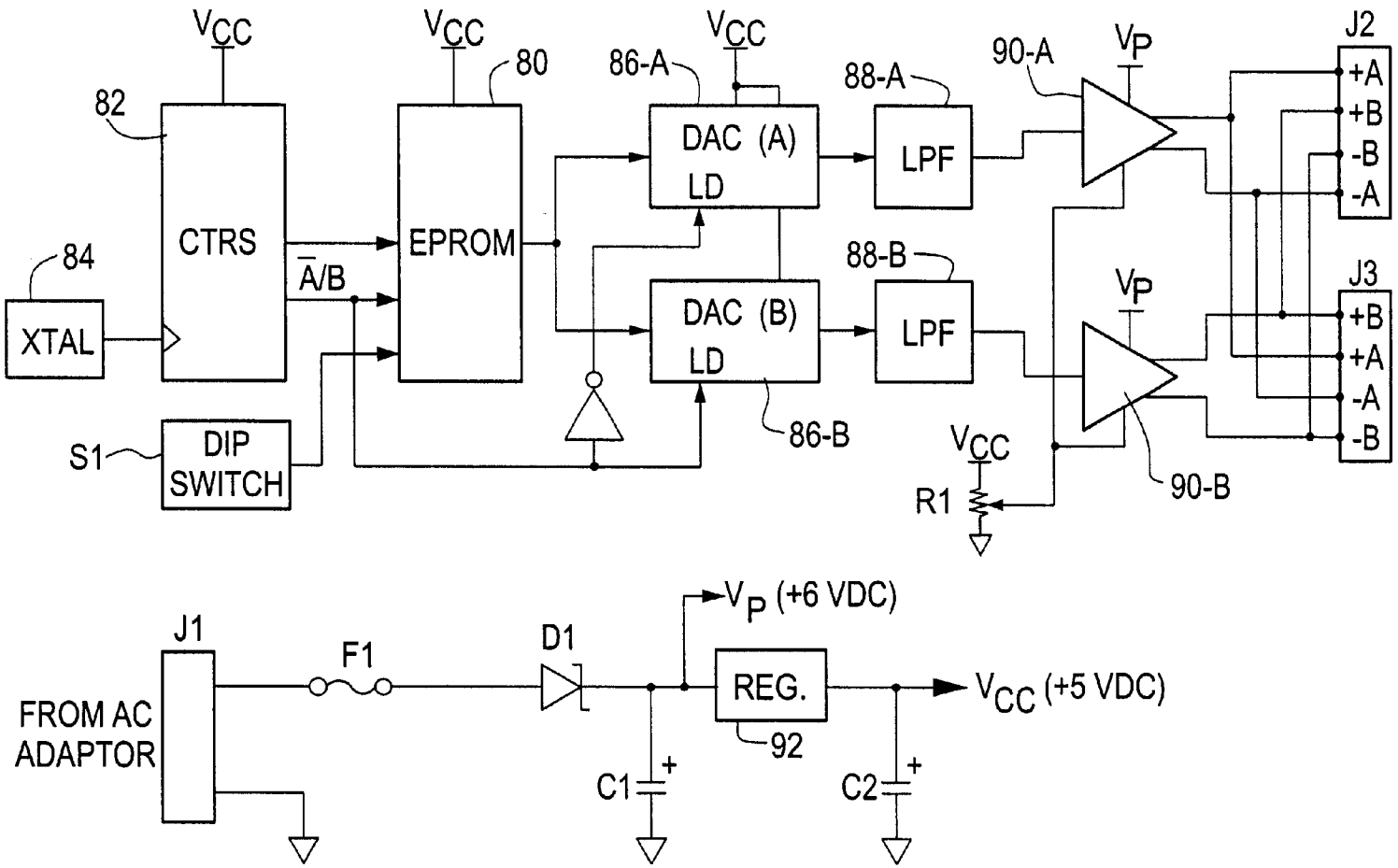
FIG. 6*a* is a schematic diagram of control circuitry on a printed circuit board in the control module of FIG. 4.
FIG. 6*b* is a schematic diagram of power supply circuitry included in the control module of FIG. 4.

FIG. 6*a*–6*b* show the electrical circuitry employed on the PCB assembly 34 to generate the sound masking signals. Data representing samples of two channels (A and B channels) of sound masking signals are stored in an erasable programmable read-only memory (EPROM) 80 (FIG. 6*a*). The samples represent approximately 3 to 4 seconds of each signal, and are accessed in a repetitive fashion to continually reproduce the 3-to-4-second interval for each channel. The samples are created in a manner that minimizes audible transients or singularities that may be objectionable in the masking signal over numerous repetitions of the segment. In particular, the beginning and ending of each signal segment is located at a zero crossing in order to provide for a smooth transition between repetitions of the signal segment.

As shown in FIG. 6*a*, a set of counters 82 driven by a crystal oscillator 84 sequentially address the samples in a repetitive fashion to produce the masking signal for each channel. Alternating values generated by the counters 82 select samples from the A and B channels, and these values are loaded into a corresponding digital-to-analog converter (DAC) 86-A or 86-B. Low-pass filters 88-A and 88-B remove high frequency alias noise, and power amplifiers 90-A and 90-B amplify the signals to levels suitable for driving the respective loudspeakers 56 (FIG. 5). The gain of the amplifiers 90-A and 90-B is established by a control signal from a potentiometer R1, which is part of the volume control 20 of FIGS. 3 and 4.

The outputs from the amplifiers 90-A and 90-B are provided to two modular jacks J2 and J3 (both part of jack housing 40 of FIG. 4) in the manner shown. Because both channel signals are available at each jack J2 and J3, the control module 14 may be connected to the loudspeaker modules 16 in a variety of ways. For example, each loudspeaker module 16 may be connected to a different one of the jacks J2 and J3 with a separate cable 18, as shown in FIGS. 1 and 3. Alternatively, it may be desirable to use a "daisy chain" configuration, in which the control module 14 is connected to a first one of the loudspeaker modules 16 using one jack J2 or J3, and the first loudspeaker module 16 is then connected to the other loudspeaker module 16 in order to forward the corresponding masking signal. Such daisy chaining can also be used in an alternative embodiment having four independent channels rather than two. In such an embodiment, different pairs of loudspeakers are daisy-chained to a corresponding jack J2 or J3, and different pairs of four independent channels are connected to corresponding ones of the jacks.

FIG. 6*b* shows power supply circuitry on the PCB assembly 34, including a jack J1 for receiving a plug from an AC adapter, a fuse F1, and a protection diode D1. The input power is filtered by capacitor C1 to provide a DC supply voltage Vp of approximately 6 volts. The supply Vp is used by the power amplifiers 90-A and 90-B as well as a 5-volt regulator 92. The output from the regulator 92 is a supply voltage Vcc filtered by a second capacitor C2.

While the illustrated embodiment does not include a power switch, it may be desirable to include a user-controlled ON/OFF switch in alternative embodiments.

Also shown in FIG. 6*a* is a dual inline package (DIP) switch used to generate two additional address inputs for the EPROM 80. The switch S1 can be used to select from among four different sets of sound masking signals programmed into the EPROM 80. As discussed below, it may be desirable to provide sound masking signals having different spectra for use in different surroundings having different acoustic characteristics. By programming the different spectra into the EPROM 80 and providing a configuration switch S1, the sound masking system can be readily adapted for use in such different surroundings, while avoiding the need to maintain different versions of the system or version-specific components.

Figure 7:
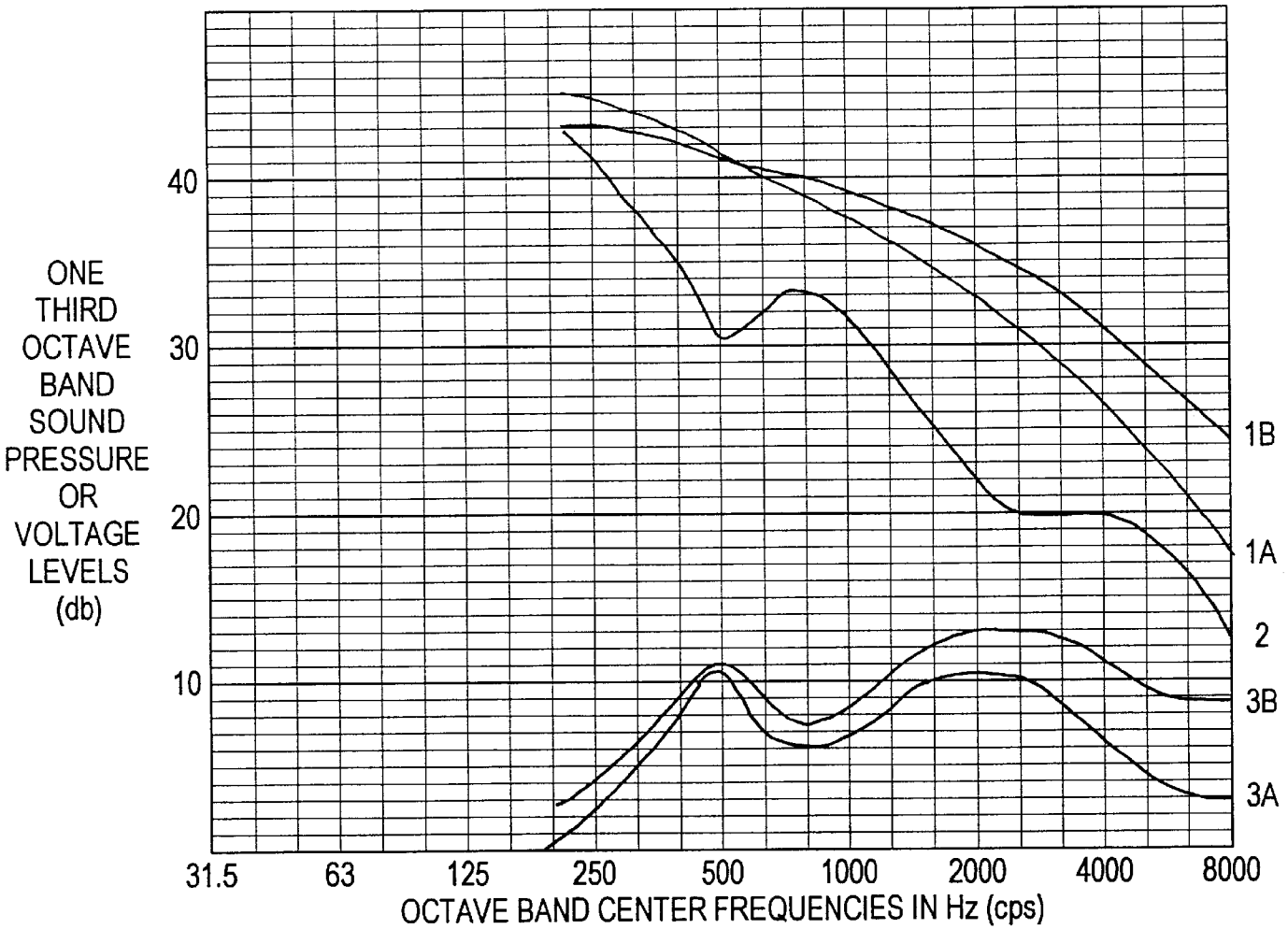
FIG. 7 is a plot of acoustic spectra of interest in the personal sound masking system of FIGS. 1–3.

FIG. 7 shows a plot of different spectra of interest in the personal sound masking system. The plotted values are sound pressure or loudspeaker terminal voltage levels, as appropriate, in ⅓-octave bands around corresponding center frequencies. Curve 1A represents a typical desired acoustical background spectrum for sound masking in an open plan type office, office "A," based on an articulation index of 0.20 and typical values of acoustical isolation between the office and an intruding source location, such as an adjacent office. Curve 2 represents the frequency response of the loudspeaker modules 16. Curve 3A is calculated as the difference between curves 1A and 2, and represents the required voltage spectrum generated by the control module 14 in order to achieve the background masking sound spectrum shown in curve 1A. It will be appreciated that the spectrum of curve 2 will generally be different in alternative embodiments employing different types or configurations of loudspeakers. It is generally desirable that the spectrum of curve 3A be matched to that of curve 2 so that the resulting background masking sound follows the spectrum of curve 1A.

Curve 1B represents a typical desired acoustical background spectrum for sound masking in another type of open office, office "B," having different ceiling materials and partition heights. Curve 3B illustrates the corresponding voltage spectrum required at the loudspeaker terminals assuming the same loudspeaker response as in case described above.

Figure 8:
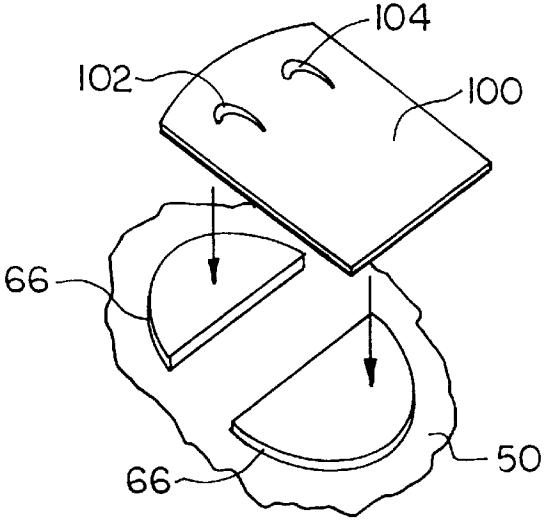
FIG. 8 illustrates an alternative mounting scheme for the loudspeaker module of FIG. 5.

FIG. 8 shows a technique for mounting each loudspeaker 16 to a cloth-covered surface, such as the wall of a typical open-plan office. A plastic pin plate 100 is secured to the adhesive-backed surface of the tab pairs 66. The pin plate 100 has embedded hooks 102 and 104 that taper to a point. The hooks 102 and 104 can be inserted into the cloth surface and then pressed downward to retain the loudspeaker on the wall.

Figure 9:
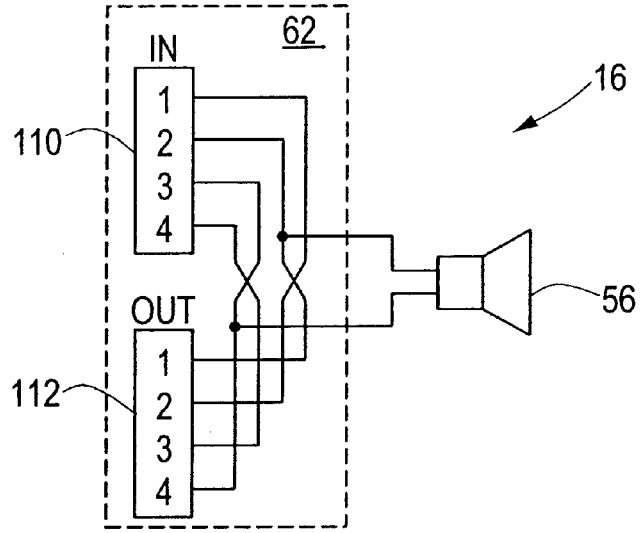
FIG. 9 is a schematic diagram of a loudspeaker module in the sound masking system of FIG. 3.

FIG. 9 shows a specific electrical configuration of the loudspeaker modules 16 that is useful in the "daisy chaining" configuration described above. The dual modular jack component 62 includes two modular jacks 110, 112, respectively labeled "IN" and "OUT" in FIG. 9. The four terminals on the IN jack 110 are connected to the four terminals on the OUT jack 112, with the respective pairs of connections for terminals 1 and 2 and terminals 3 and 4 each being reversed, as shown. The loudspeaker 56 is connected to terminals 2 and 3 of the IN jack 110.

To daisy-chain multiple loudspeakers 56, it is necessary to simply connect the OUT jack 112 of each loudspeaker 56 to the IN jack 110 of the next loudspeaker 56 in the chain. Because of the wiring reversal in each modular jack component 62, each successive loudspeaker 56 in the chain is connected alternately to the A and B channels. The labels IN and OUT in FIG. 9 conveniently differentiate the two jacks 110, 112 for purposes of correct daisy-chaining. In an actual system, it may be useful to employ the IN and OUT labels or suitable alternative labels to ensure proper daisy-chaining by installation personnel.

Figure 10:
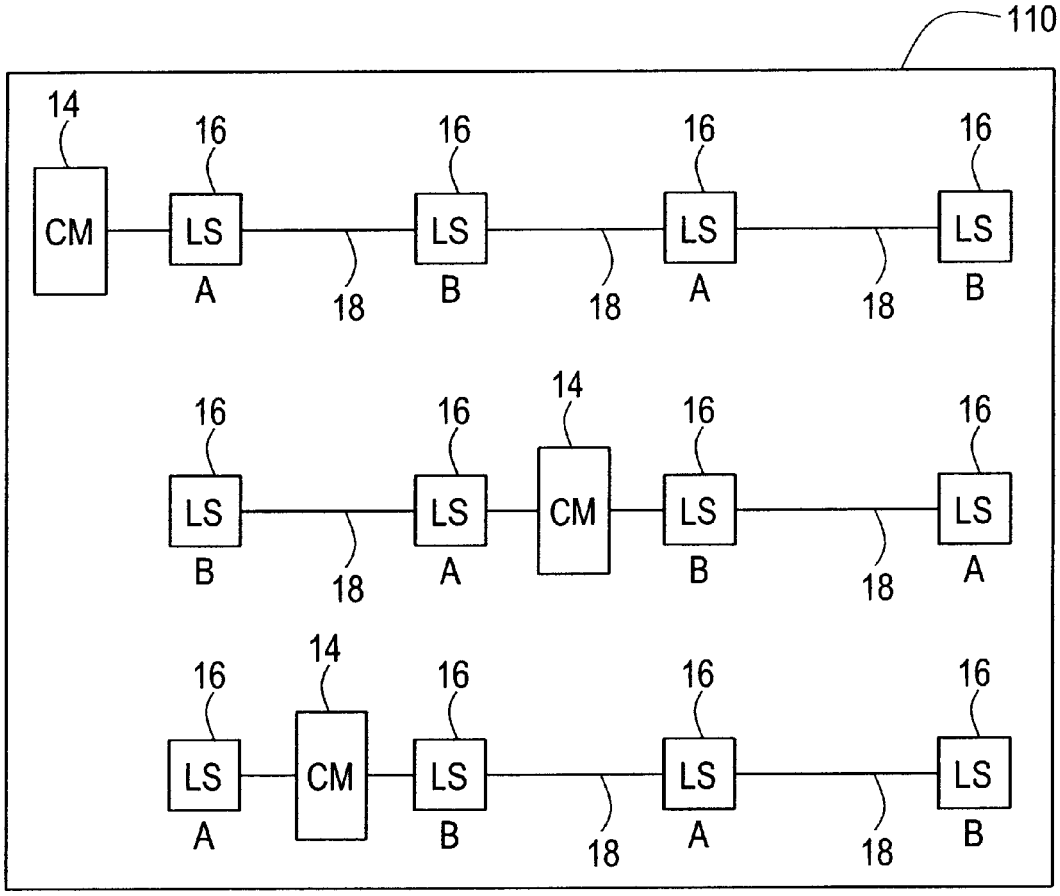
FIG. 10 is a plan diagram showing how multiple sound masking systems can be arranged in an open office area.

FIG. 10 depicts an arrangement of multiple sound masking systems in a multi-occupant work area 110, such as a call center or similar open-office area. In this arrangement, the individual systems are not located solely within the confines of each individual's work space in the manner described above. Rather, the loudspeaker modules 16 are located relatively close to the ceiling and distributed throughout the area so as to perform sound masking for the entire population of the work area. Each system includes a control module 14 and a set of loudspeaker modules 16 interconnected by cables 18 as shown. The control module 14 may be located at one end of the daisy chain or at intermediate points, in which case it is desirable to split the system into two smaller daisy chains each connected to a different jack J2 or J3 of the control module 14 (FIG. 6*a*). Through the use of the wiring scheme of FIG. 9, each successive loudspeaker module 16 along a chain emits a different one of the two channels, as indicated by the labeling "A" and "B" for the loudspeaker modules 16 in FIG. 10.

Figure 11:
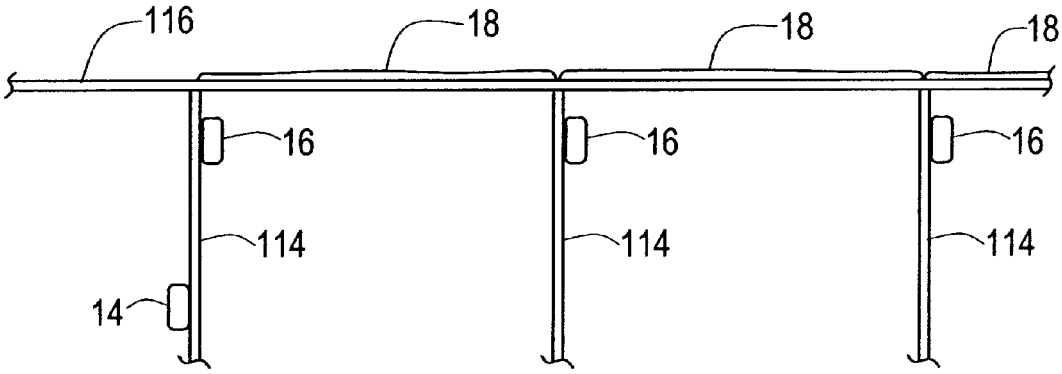
FIG. 11 is an elevation diagram showing the attachment and interconnection of several loudspeakers modules in the arrangement of FIG. 10.

FIG. 11 illustrates the multi-system arrangement of FIG. 11 from the elevation perspective. Each loudspeaker module 16 is attached to a respective conduit 114 extending downwardly from the ceiling 116 to one or more individual work areas (not shown). The control module 14 for a system can be mounted in any of a variety of ways, including attachment to a conduit 114 as shown. The cables 18 are run vertically within the conduits 114 and horizontally above the ceiling 116.

In a system such as shown in FIGS. 10 and 11, it is preferable that the volume of the sound masking signals not be user-adjustable, in contrast to the personal configuration described above, because the aim is to achieve sound masking over a multiple-user area with common signals. Volume adjustability can be defeated by placing the control modules 14 in a normally inaccessible place, such as near or even above the ceiling 116, or by omitting the external volume control 20 (FIG. 4). The volume levels for the various signals are preferably set at the time of installation of the sound masking systems, in a manner similar to that described above for above-ceiling systems.

It may be desirable to employ more than two distinct incoherent signals to achieve improved sound masking performance. To this end, each control module 14 may generate different signals in four different channels, for example, and provide each channel to one or more jacks in a manner analogous to that shown in FIG. 6*a*. In such a case, the loudspeaker modules 16 preferably implement a cross connection scheme analogous to that of FIG. 9 ensuring that each set of four loudspeakers 56 in a chain emit different signals. Any of a wide variety of similar configurations may be employed. Also, it may be desirable that different control modules 14 emit different sets of signals, for example by using an expanded version of the signal selection scheme described above in connection with FIG. 6*a*.

While in the foregoing description the personal sound masking system includes two separate loudspeaker modules 16 and a separate control module 14, it may be desirable in alternative embodiments to integrate the PCB assembly 34 with one of the loudspeakers 56 in a combined control/ loudspeaker module. Alternatively, to enhance portability the PCB assembly 34 and both loudspeakers 56 may be integrated into a single housing. As another variant, the loudspeaker modules 16 may be configured to be removably attachable to the control module 14 for enhanced portability, in a manner similar to portable stereo music systems or "boom boxes."

A sound masking system like that of FIGS. 10 and 11 features improved sound masking in small areas within large spaces, due to the use of several small speakers scattered throughout the target area versus one or two in-ceiling units for the same area. Additionally, costs for the components and installation are low. When both the units and the wiring are below the ceiling plenum, materials do not have to be fire-proof. Additionally, the system is easily moved when necessary, for example when an organization moves out of a building.

Regarding the signal-generating circuitry, it may be desirable that the memory used to store the signal samples be field programmable, for example to enable fast and cost-effective updating. Thus in alternative embodiments the EPROM 80 may be replaced by an electrically erasable device such as an EEPROM or a flash-programmable RAM.

In the illustrated embodiment the spectrum of the sound-masking signal is determined primarily by the collection of samples stored in a memory and sequentially played out via the DACs 86. It may be desirable in alternative embodiments to generate each masking signal using a cascaded circuit including a pseudo-random noise generator and a spectrum-shaping filter, where the noise generators for the different channels are mutually incoherent. The filters may be either digital or analog, and may include programmability features in order to provide flexibility in matching the spectra of the generated masking signals with the response of the loudspeaker modules.

In the foregoing, the sound masking system has been described as a distinct entity apart from other elements of a typical office. In alternative embodiments it may be desirable to integrate the sound masking function into another component, such as for example a multimedia personal computer (PC) used in the office. In such an embodiment the masking signal data may be recorded on a computer memory device such as a magnetic disk or optical disk, or it may be loaded into system memory from a network. Audio player software running in the background can play the masking signal through the PC's loudspeakers.

It will be apparent to those skilled in the art that modification to and variation of the above-described methods and apparatus are possible without departing from the inventive concepts disclosed herein. Accordingly, the invention should be viewed as limited solely by the scope and spirit of the appended claims.

What is claimed is:

1. A sound masking system, comprising:

a masking signal generator operative to generate a plurality of incoherent masking sound signals, the masking sound signals having spectra tailored to achieve a desired masking sound spectrum when the masking sound signals are emitted by loudspeakers in a multi-occupant workspace; and a plurality of loudspeaker modules, the loudspeaker modules and masking signal generator being interconnected in a daisy-chain fashion such that the masking sound signals are received by each loudspeaker module on respective input connections and transmitted to an adjacent loudspeaker on respective output connections, each loudspeaker module including a loudspeaker connected to a predetermined one of the input connections, the interconnection between each pair of adjacent loudspeaker modules being operative to shift the input connections on which the respective masking sound signals appear such that successive loudspeakers emit different ones of the masking sound signals.

2. A sound masking system according to claim 1, wherein each loudspeaker module includes an internal connection network between the input connections and the output connections, and the connections between each pair of adjacent loudspeaker modules includes the internal connection network of one of the loudspeaker modules and an external cable extending between the two loudspeaker modules, the external cable for each adjacent pair of loudspeaker modules being operative to transfer the masking sound signals between the two loudspeaker modules without shifting the connections on which the masking sound signals appear, and the internal connection network of each loudspeaker module being operative to performing the shifting of the masking sound signals as they propagate from the input connections to the output connections.

3. A sound masking system according to claim 1, wherein each loudspeaker module includes two jacks, one jack including the input connections and receiving a first detachable cable connecting the loudspeaker module to the preceding loudspeaker module, the other jack including the output connections and receiving a second detachable cable connecting the loudspeaker module to the succeeding loudspeaker module.

4. A sound masking system according to claim 3, wherein each detachable cable is operative to transfer the masking sound signals between two successive loudspeaker modules without shifting the connections on which the masking sound signals appear, and wherein each loudspeaker module includes an internal connection network between the first and second jacks operative to performing the shifting of the masking sound signals as they propagate from the input connections to the output connections.

5. A sound masking system according to claim 3, wherein the number of masking sound signals is two.

6. A sound masking system according to claim 1, wherein the number of masking sound signals is two.

7. A sound masking system according to claim 1, wherein the plurality of daisy-chained loudspeaker modules is a first daisy chain of loudspeaker modules connected to a first set of output connections of the masking signal generator, and further comprising a second daisy chain of loudspeaker modules connected to a second set of output connections of the masking signal generator.

8. A sound masking system according to claim 7, wherein the masking sound signals appearing on the first set of output connections of the masking signal generator are the same as the masking sound signals appearing on the second set of output connections of the masking signal generator.

9. A sound masking system according to claim 7, wherein the masking signal generator includes two jacks, one jack including the first set of output connections and the other jack including the second set of output connections.

10. A sound masking system according to claim 7, wherein each loudspeaker module of each daisy chain is attached to the upper part of a corresponding one of a plurality of rigid vertical members disposed in the multi-occupant workspace, and wherein the connections between each pair of successive loudspeaker modules in each daisy chain are carried by a respective cable extending between the corresponding pair of vertical members.

11. A sound masking system according to claim 10, wherein the rigid vertical members are conduits and each cable extends within a conduit from the attached loudspeaker to a cable egress point above the loudspeaker.

12. A sound masking system according to claim 11, wherein the cable egress point is an opening at the upper end of the conduit.

13. A sound masking system according to claim 10, wherein each cable includes a horizontal portion disposed above a ceiling over the multi-occupant workspace.

14. A sound masking system according to claim 10, further comprising rigid horizontal members each extending between a corresponding pair of the vertical members, and wherein each cable includes a horizontal portion extending along the outside of the corresponding horizontal member.

15. A sound masking system according to claim 1, wherein each loudspeaker module of each daisy chain is attached to the upper part of a corresponding one of a plurality of rigid vertical members disposed in the multi-occupant workspace, and wherein the connections between each pair of successive loudspeaker modules in each daisy chain are carried by a respective cable extending between the corresponding pair of vertical members.

16. A sound masking system according to claim 15, wherein the rigid vertical members are conduits and each cable extends within a conduit from the attached loudspeaker to a cable egress point above the loudspeaker.

17. A sound masking system according to claim 16, wherein the cable egress point is an opening at the upper end of the conduit.

18. A sound masking system according to claim 15, wherein each cable includes a horizontal portion disposed above a ceiling over the multi-occupant workspace.

19. A sound masking system according to claim 15, further comprising rigid horizontal members each extending between a corresponding pair of the vertical members, and wherein each cable includes a horizontal portion extending along the outside of the corresponding horizontal member.

* * * * *

UNITED STATES PATENT AND TRADEMARK OFFICE

CERTIFICATE OF CORRECTION

PATENT NO. : 6,888,945 B2
APPLICATION NO. : 09/780978
DATED : May 3, 2005
INVENTOR(S) : Horrall It is certified that error appears in the above-identified patent and that said Letters Patent is hereby corrected as shown below:

Column 5, line 29, delete “30”;

Column 7, line 5, “switch used” should read --switch S1 used--.

Signed and Sealed this

Eighteenth Day of July, 2006

JON W. DUDAS
*Director of the United States Patent and Trademark Office*